US007475757B2

(12) United States Patent
Valk et al.

(10) Patent No.: US 7,475,757 B2
(45) Date of Patent: Jan. 13, 2009

(54) ELEVATOR DISPATCHING WITH BALANCED PASSENGER PERCEPTION OF WAITING

(75) Inventors: Mary Ann T. Valk, Glastonbury, CT (US); David J. Sirag, Ellington, CT (US)

(73) Assignee: Otis Elevator Company, Farmington, CT (US)

( * ) Notice: Subject to any disclaimer, the term of this patent is extended or adjusted under 35 U.S.C. 154(b) by 517 days.

(21) Appl. No.: 10/554,131

(22) PCT Filed: Jun. 23, 2003

(86) PCT No.: PCT/US03/19944

§ 371 (c)(1), (2), (4) Date: Oct. 20, 2005

(87) PCT Pub. No.: WO2005/009879

PCT Pub. Date: Feb. 3, 2005

(65) Prior Publication Data

US 2006/0196732 A1 Sep. 7, 2006

(51) Int. Cl.
*B66B 1/18* (2006.01)

(52) U.S. Cl. ..... 187/382; 187/247

(58) Field of Classification Search ..... 187/391, 187/247, 380–389

See application file for complete search history.

(56) References Cited

U.S. PATENT DOCUMENTS 4,244,450 A 1/1981 Umeda et al.
4,719,996 A 1/1988 Tsuji
5,024,295 A 6/1991 Thangavelu
5,239,142 A 8/1993 Ekholm et al.
5,250,766 A * 10/1993 Hikita et al. ..... 187/391
5,304,752 A 4/1994 Hayashi
5,672,853 A 9/1997 Whitehall et al.
5,789,715 A 8/1998 Kakko et al.
5,865,274 A * 2/1999 Kiji et al. ..... 187/380
6,241,050 B1 6/2001 Hikita et al.

OTHER PUBLICATIONS

PCT International Search Report for PCT/US03/019944, dated Mar. 26, 2004.

PCT International Preliminary Examination Report for PCT/US03/019944, dated Aug. 22, 2005.

* cited by examiner

*Primary Examiner*—Jonathan Salata

(57) ABSTRACT

A perceived waiting time for a hall call to be answered by a car is determined as a constant times the square (46) of the summation (45) of remaining response time (39) and the amount of time that has expired since the call was registered (38). The time that may be perceived by a passenger to travel to the passenger's destination is determined as a constant times the square (51) of the distance between an estimated destination floor and the floor of the call and a constant times an estimated number of new hall stops and committed hall stops that each car will make (47). Perceived service time is (52) the sum of perceived wait time and perceived travel time. Constants are adjusted so that a long waiting time will yield a quick travel time. Assignment of calls to cars (60) is in accordance (61) with the smallest summation of square (59) of perceived service times for all waiting up calls and down calls.

3 Claims, 2 Drawing Sheets

ELEVATOR DISPATCHING WITH BALANCED PASSENGER PERCEPTION OF WAITING

TECHNICAL FIELD

This invention relates to elevator dispatching in which the passenger's perception of wait time prior to arrival of an elevator is balanced against the passenger's lesser perception of the travel time in the elevator, and selecting call assignments which provides a lowest function of overall perceived time for service.

BACKGROUND ART

In elevator dispatching, the passenger's perception of how long he or she waits for an elevator to arrive has been determined to be non-linear, in the sense that the longer the passenger waits, the more the passenger perceives that he or she has waited longer than the actual wait time. Stated alternatively, the degree of annoyance of waiting is not a linear function of the wait, but increases, perhaps exponentially, with the elapse of time. In U.S. Pat. No. 5,304,752, preferential passenger service is allotted to an individual whose waiting time is longer than the waiting time of all passengers currently waiting for elevator service. In U.S. Pat. No. 4,244,450, the dispatcher uses an increased function of waiting time, which increases with duration of the wait, to dispatch cars more in accordance with passengers' perception of waiting. In that patent, the assignment is based on providing a minimum sum of the overall perceived waiting time for all waiting passengers. Many systems provide for displays that will indicate the time remaining for calls to appear, so that passengers are comfortable with the fact that response is impending; one example is U.S. Pat. No. 5,789,715.

DISCLOSURE OF INVENTION

Objects of the invention include: improving passenger perception of waiting and service times in an elevator system; dispatching elevators to respond to hall calls in a manner that causes passengers to perceive minimum annoyance in waiting; and elevator dispatching which provides improved passenger approval in the manner in which elevator calls are responded to and serviced.

This invention is predicated, first, on our discovery that the perception of a long waiting time by a prospective elevator passenger is greater for the time spent waiting for the arrival of the elevator car than is the perception of the time that it takes to be served, that is, the travel time to the destination floor. The invention is predicated also in part on our discovery that overall perception, among all passengers, of non-offensive times in being served by elevators is lower if the controlling metric is the minimum of the sums of squares, or other exponential function, of the overall perceived delay of all passengers in reaching the destination floor.

According to the present invention, a perceived waiting time, which is a function of an expected time before a particular car can answer a particular call, and a perceived travel time, which is a function of weighted values of travel time to a destination floor (either estimated or actual) and time to accommodate committed and expected stops, are summed to provide a perceived service time; the before service waiting time is weighted more heavily than the perceived travel time. In accordance with the invention further, for all possible sets of assignments for all unanswered up hall calls and down hall calls currently waiting in the elevator system, the perceived service time (waiting and traveling) for all outstanding hall calls are squared, and the squares are summed; the set of assignments which provides the smallest total sum of the squares is the set upon which assignments of cars to answer calls is based.

The present invention may utilize neural networks to determine some of the components of those factors upon which call assignments are based. Specifically, remaining response time, conventionally referred to as RRT, may be determined by neural networks as disclosed in U.S. Pat. No. 5,672,853. Other estimates, such as expected travel time and expected new stop commitments for each car may also be determined, if desired, utilizing the neural network processing methodology disclosed in U.S. Pat. No. 5,672,853.

Other objects, features and advantages of the present invention will become more apparent in the light of the following detailed description of exemplary embodiments thereof, as illustrated in the accompanying drawing.

MODE(S) FOR CARRYING OUT THE INVENTION

Figure 1:
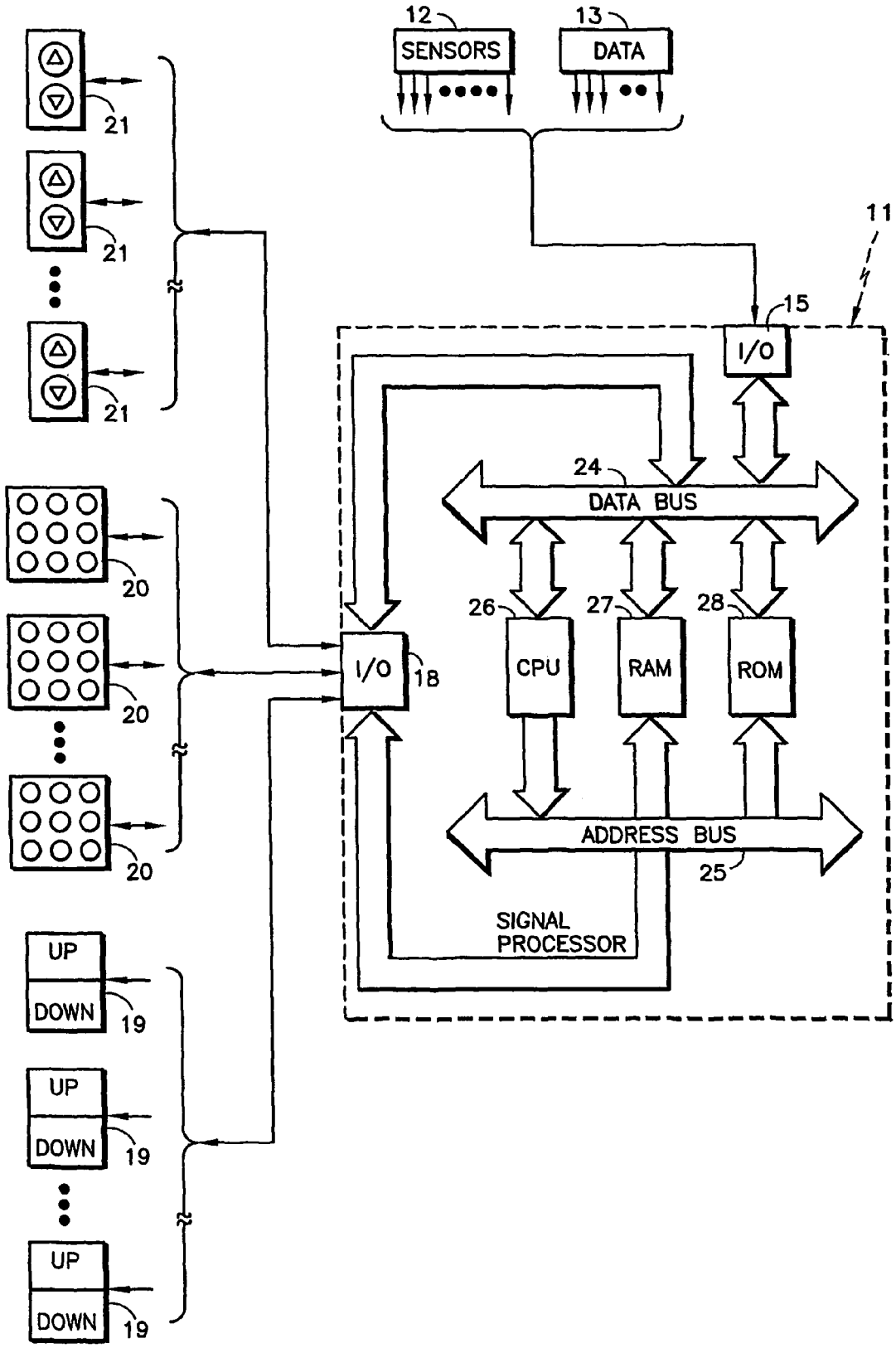
FIG. 1 is a schematic diagram of a conventional computer arrangement interfacing with elevators, as an example of a system in which the present invention may be practiced.

Referring to FIG. 1, a signal processor 11 is illustrative of group controllers that may allocate cars to respond to hall calls, utilizing aspects of the present invention. The processor 11 is responsive to a plurality of sensors 12, such as car weight sensors, and data signals 13, such as car direction and door condition, provided to an input/output (I/O) port 15 of the processor 11. Similarly, another I/O port 18 is connected to a plurality of hall call buttons 19 resident on the various floors of the building, a plurality of car call button panels 20, one resident in each car, and a plurality of hall lanterns 21, of which there are typically one or more at each floor landing. The processor 11 includes a data bus 24, an address bus 25, a central processing unit (CPU) 26, a random access memory (RAM) 27, and a read only memory (ROM) 28 for storing the requisite elements of programs or routines that can carry out the present invention.

Figure 2:
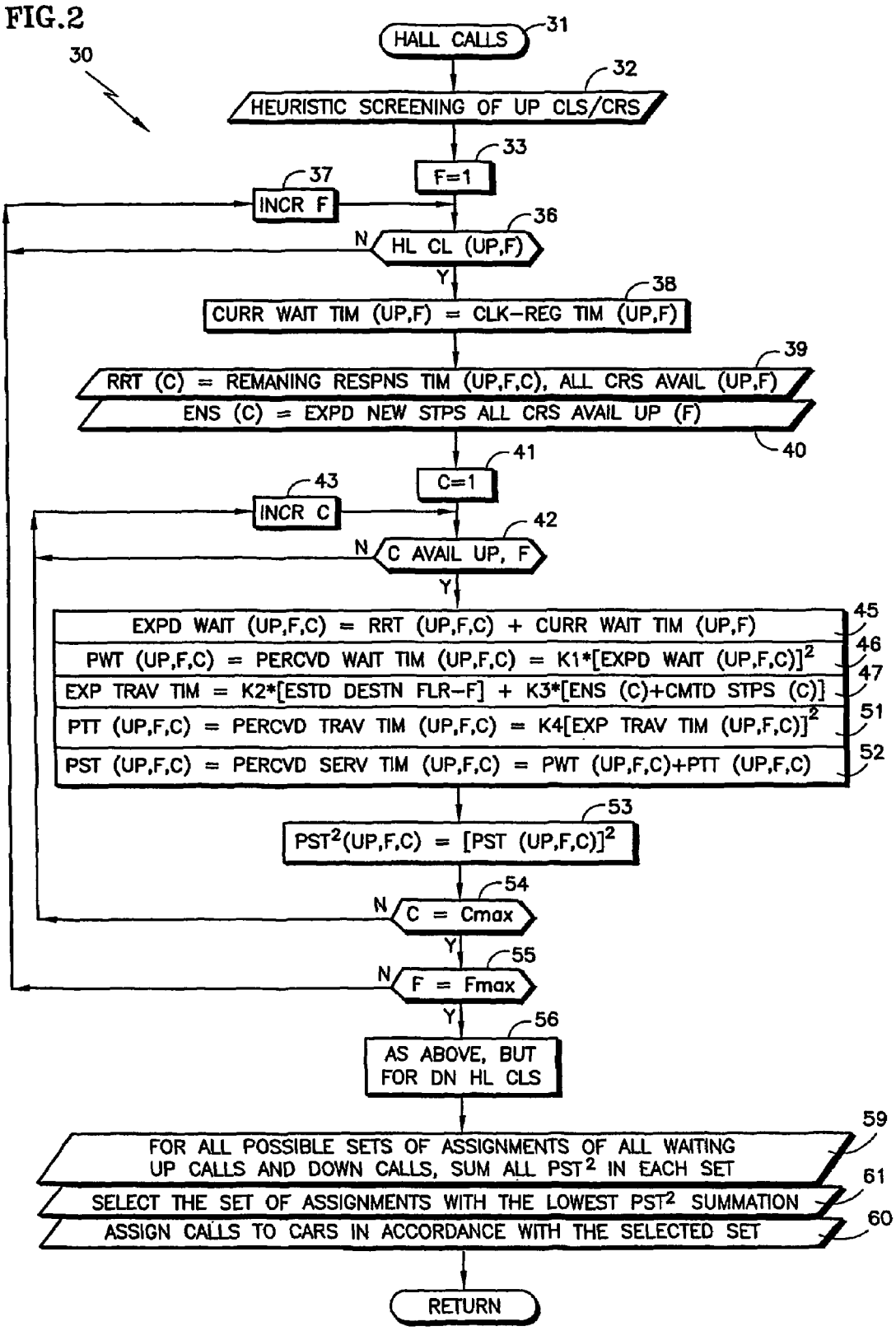
FIG. 2 is a simplified logic flow diagram which is exemplary of processes that may be utilized to practice the present invention.

In the routine of FIG. 2, it is assumed that up hall calls are processed first and then down hall calls are processed, after which all of the calls together are processed as is about to be described.

Referring to FIG. 2, a hall call allocation program 30 is reached through an entry point 31 and a first subroutine 32 (or a series of them) may perform heuristic screening of up hall calls against available cars. This will eliminate cars, for instance, that are full and for which the call in question is ahead of the next floor call for that car. This will eliminate a car which has been assigned "taxi" service to respond to a very old hall call, cars that are in the wrong direction of travel for their position in the building, or cars for which calls are outside of a car's reach, due to some factor such as up peak sector assignment. All of this is conventional, and not part of the invention.

A step 33 sets a floor counter, F, to one. Then, a test 36 determines if there is a hall call in the up direction on floor F. If not, a negative result of test 36 reaches a step 37 to increment F, and the next floor is tested in turn to see if there is a hall call on that floor.

If there is an up hall call on floor F, a step 38 determines the current wait time for the up hall call on floor F as being equal to the present clock time minus the time at which the call at floor F was registered. Then, a subroutine (or series of them)

39 will determine remaining response time for each car, C, for the up hall call on floor F, for all of the cars that are available to answer the up hall call on floor F. This may be preferentially be done in accordance with the aforementioned U.S. Pat. No. 5,672,853; otherwise, remaining response time can be determined in a number of other known ways.

A subroutine 40, or a series of them, then determines estimated new stops for all cars, C, available to answer the up call on floor F. Then, a car counter, C, is set to one in a step 41. A test 42 determines if car C is available to respond to the up call at floor F; if not, the C counter is incremented in a step 43 and the test 42 is once again reached. If the car is available, a step 45 determines the expected wait time, that is, the estimated time before car C will reach the up call on floor F, as the remaining response time for car C to reach the up call at floor F (as determined in the subroutine 39) plus the time that the passenger has currently waited (as previously determined in step 38). The perceived wait time is determined in a step 46 as some constant, K1, times the square of the expected wait time of step 45. However, a function other than the square may be used.

An expected travel time is determined in a step 47 as the summation of some constant, K2, times the distance between the estimated destination floor and the floor F where the call is registered along with some constant, K3, times the summation of the expected new stops and the committed stops of car C prior to reaching floor F. The estimated destination floor may be the actual destination floor in a building having destination call buttons; or it could be a floor determined by historical date and call data for calls originating on floor F, utilizing artificial intelligence, with or without the assistance of the process just disclosed in U.S. Pat. No. 5,672,853 involving neural networks. Or, the estimated destination floor may simply be one-half of the distance between floor F and the highest floor in the building. Whichever is utilized is irrelevant to the present invention.

A perceived travel time (PTT) is determined in a step 51 as a constant, K4, times the square of the expected travel time that was determined in step 47. However, a function other than the square may be used. Then, a perceived service time (PST), that is, the passenger's perception of the amount of time that it will take to get to his or her destination, is determined in a step 52 as the summation of the perceived waiting time and the perceived travel time. Then the perceived service time is squared in a step 53. Of course, the steps 45-53 may all be combined in a single, long formulation instead of being performed one step at a time as shown.

The constant K1 and the functions shown as squares in steps 46 and 51 may either or both be adjusted relative to the constants K2-K4 and the non-linear function, which is a square in step 51, so that a car that has been assigned to a call which waits a long time for the car to arrive will be a car which will take the passenger most quickly to his or her destination, thereby to lower the overall perception of waiting, including waiting for the elevator car to arrive and waiting for the car to deliver the passenger to his or her destination.

A test 54 determines if all of the cars have been tested for possible service to the up call at floor F. If not, the program reverts to the step 43 where C is incremented, and the next car in turn is tested in test 42 to see if it is available to answer the up call at floor F. If it is, the process just described will repeat for that car; if not, the car count is incremented and the next car in turn is tested.

Eventually, all of the cars will have been processed with respect to an up call at floor F and a test 55 will determine if all of the floors have had their up calls processed. Originally, they will not have, so a negative result of test 55 causes the routine to revert to the step 37 to increment F so that it can be determined in test 36 whether the next floor has a hall call in the up direction. If so, the process described will be repeated for this and subsequent floors until the test 55 is affirmative, indicating that all up calls have been processed.

Then a series 56 of tests, steps and subroutines will be performed which are the same as the tests, steps and subroutines 32-55, but for down hall calls.

Another aspect of the invention is forcing the system to try to equalize the perceived service time across all passengers. Using the lowest summation of the squares of the perceived service times for assignment of cars to calls will select a set of assignments having service times which are closer to each other. As an example, assume a PST of call A equal to 10 and PST of call B equal to 10; the sum of the squares equals 200. On the other hand, if the PST for call A equals 9, and the PST for call B equals 11, the sum of the squares is 202, which is a less favorable overall scenario. If only the first power of the PSTs were summed, the result would be 20 in each case, thereby not being indicative of overall preferred performance. This is one aspect of the present invention. When the processing of all up calls and all down hall calls is complete, the sums are taken of the squares of all perceived service times for all the possible assignments of cars to up calls and down calls in a subroutine 59, for all possible sets of assignments of all waiting up calls and down calls; cars will then be assigned to calls by a subroutine 60 based on that set of assignments which has the lowest summation of squares of perceived service time, as determined by a subroutine 61.

The invention claimed is:

1. A method of assigning selected ones of a plurality of elevator cars to answer hall calls outstanding in a multifloor building, comprising the steps of:

for each car available to serve a particular hall call outstanding in a building, (a) determining (45) an estimate of the wait time that will elapse after being registered before each said call will be answered;

(b) providing (46) a perceived wait time as a first constant times a first non-linear function of each said wait time;

(c) determining (47) an estimate of the travel time that will elapse after said each call is answered before reaching an estimated destination of a passenger registering said each call;

(d) providing (51) a perceived travel time as a second constant times a second non-linear function of each said travel time;

(e) providing (52) a perceived service time as a summation of said perceived wait time and said perceived travel time for each said wait time and corresponding travel time; and (f) allocating (59) said available cars to respond to said outstanding hall calls based on said perceived service times.

2. A method according to claim 1 wherein: said second constant and said second non-linear function are selected along with said first constant and said first non-linear function so that a hall call having a relatively long wait time for a particular car will have a relatively short travel time to reach an estimated destination in said particular car.

3. A method according to claim 1 wherein said step (f) comprises: providing the square (53) of each said perceived service time; for all possible sets of assignments of all said up hall calls and down hall calls outstanding in said building, providing (59) a summation of said squares; and assigning cars to calls (60) in accordance with the one of said sets having the lowest of said summations (61).

* * * * *